US007063567B2

(12) United States Patent
Ishikawa

(10) Patent No.: US 7,063,567 B2
(45) Date of Patent: Jun. 20, 2006

(54) CONNECTOR

(75) Inventor: Ryotaro Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/044,904

(22) Filed: Jan. 27, 2005

(65) Prior Publication Data

US 2005/0170702 A1 Aug. 4, 2005

(30) Foreign Application Priority Data

Feb. 2, 2004 (JP) ..... 2004-025492

(51) Int. Cl.
*H01R 13/60* (2006.01)

(52) U.S. Cl. ..... 439/595

(58) Field of Classification Search ..... 439/595, 439/598, 752, 352
See application file for complete search history.

(56) References Cited

U.S. PATENT DOCUMENTS 5,554,052 A 9/1996 Saijo et al.
5,820,411 A * 10/1998 Okabe ..... 439/595
6,244,900 B1 * 6/2001 Ishikawa et al. ..... 439/595
6,764,335 B1 * 7/2004 Ichio ..... 439/595
6,764,352 B1 * 7/2004 Tsuji ..... 439/752
6,767,259 B1 * 7/2004 Kojima et al. ..... 439/752
6,790,085 B1 * 9/2004 Nankou et al. ..... 439/595

FOREIGN PATENT DOCUMENTS

JP 5-234640 8/1993

* cited by examiner

*Primary Examiner*—Phuong Dinh
(74) *Attorney, Agent, or Firm*—Gerald E. Hespos; Anthony J. Casella

(57) ABSTRACT

A housing (10) is formed with an excessive deformation preventing portion (29) for preventing an excessive deformation of a locking portion (17) beyond its resiliency limit by being brought into contact with a part of the locking portion (17) behind a free end (17F) when the locking portion (17) is resiliently deformed toward a deformation space (23). Since the excessive deformation preventing portion (29) of the present invention to be brought into contact with the part of the locking portion (17) behind the free end (17F) is located at a position closer to the locking portion (17) as compared to the one to be brought into contact with a free end of a locking portion, a connector A can be miniaturized along a deformation direction of the locking portion (vertical direction).

8 Claims, 10 Drawing Sheets

CONNECTOR

BACKGROUND OF THE INVENTION

FIELD OF THE INVENTION

The present invention relates to a connector.

SUMMARY OF THE INVENTION

Japanese Unexamined Patent Publication No. H05-234640 and FIG. 10 herein disclose a connector with a housing made of a synthetic resin and a terminal fitting that can be inserted and retained in the housing. With reference to FIG. 10, the connector has a housing 100 and a terminal fitting 101 that is inserted into a cavity 102 formed in the housing 100. A lock 103 is cantilevered to extend along an inner wall of the cavity 102 for locking the terminal fitting 101 in the cavity 102. The lock 103 interferes with the terminal fitting 101 as the terminal fitting 101 is inserted into the cavity 102. Thus, the lock 103 deforms towards a deformation space 104 at a side opposite from the cavity 101, as shown in phantom line in FIG. 10. The lock 103 restores resiliently to engage the terminal fitting 101 as shown in solid line in FIG. 10, when the terminal fitting 101 reaches a proper insertion position. As a result, the terminal fitting 101 is locked so as not to come out. A jig (not shown) can be used for withdrawing the locked terminal fitting 101 from the housing 100. The jig can be inserted into the deformation space 104 from the front of the housing 100 to catch and deform the lock 103, thereby disengaging the lock 103 from the terminal fitting 101.

An excessive deformation preventing portion 105 is provided to avoid an excessive deformation of the lock 103 by the jig. More particularly, a free end 103*a* of the lock 103 contacts the excessive deformation preventing portion 105 to prevent any further deformation of the lock 103. With this design, the cavity 102, the lock 103, the deformation space 104 and the excessive deformation preventing portion 105 are arranged along a deforming direction of the lock 103, thereby presenting a problem of enlarging the connector in the deforming direction of the lock 103.

The invention was developed in view of the above problem and an object is to miniaturize a connector along a deforming direction of a lock.

SUMMARY OF THE INVENTION

The invention relates to a connector with a housing formed with at least one cavity. A lock is cantilevered forward along an inner wall of the cavity. The lock interferes with a terminal fitting as the terminal fitting is inserted into the cavity. As a result, the lock deforms and inclines towards a deformation space at a side of the lock opposite from the cavity. The lock restores resiliently to engage the terminal fitting when the terminal fitting reaches a proper insertion position. At least one excessive deformation preventing portion is provided for contacting the lock to prevent the lock from deforming beyond its resiliency limit. The excessive deformation preventing portion is disposed to contact a part of the lock behind the free end. Thus, the excessive deformation preventing portion is closer to the lock along a deforming direction of the lock as compared to a construction for bringing a free end of a lock into contact with an excessive deformation preventing portion. Thus, the connector can be miniaturized along the deforming direction of the lock.

The lock preferably is formed with contact portions projecting sideways at opposite lateral surfaces of the lock behind the free end of the lock. The contact portions preferably simultaneously contact the excessive deformation preventing portion. Thus, the posture of the lock is not likely to incline transversely.

The contact portion preferably extends continuously from a base end of the lock towards the free end.

The lock is resiliently deformable with its base end as a support. An area of the lock at the base end is made wider by the contact portions. Thus, the rigidity of the lock against deformation is higher and the function of the lock to lock the terminal fitting has higher reliability.

The housing preferably has an accommodating space for accommodating a part of the lock adjacent the free end when the lock is held in contact with the excessive deformation preventing portion. Thus, the free end of the lock does not project out of the housing.

The accommodating space preferably is exposed at an outer side surface of the housing. Thus, the connector can be made smaller by as much as the thickness of the outer wall as compared to a connector with an accommodating space that is closed by an outer wall extending along the outer surface of a housing.

The accommodating space preferably is slightly wider than an area of the lock where the contact portions are not formed, but narrower than an area of the lock where the contact portions are formed.

The part of the lock and the excessive deformation preventing portions preferably come substantially into line contact along a horizontal line at an angle, preferably substantially normal to a resiliently deforming direction of the lock.

A vertical dimension of the deformation space preferably is smallest at a base end of the lock and gradually increases towards the free end.

A displacement in the deforming direction of the free end of the lock preferably exceeds the maximum vertical dimension of the deformation space.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
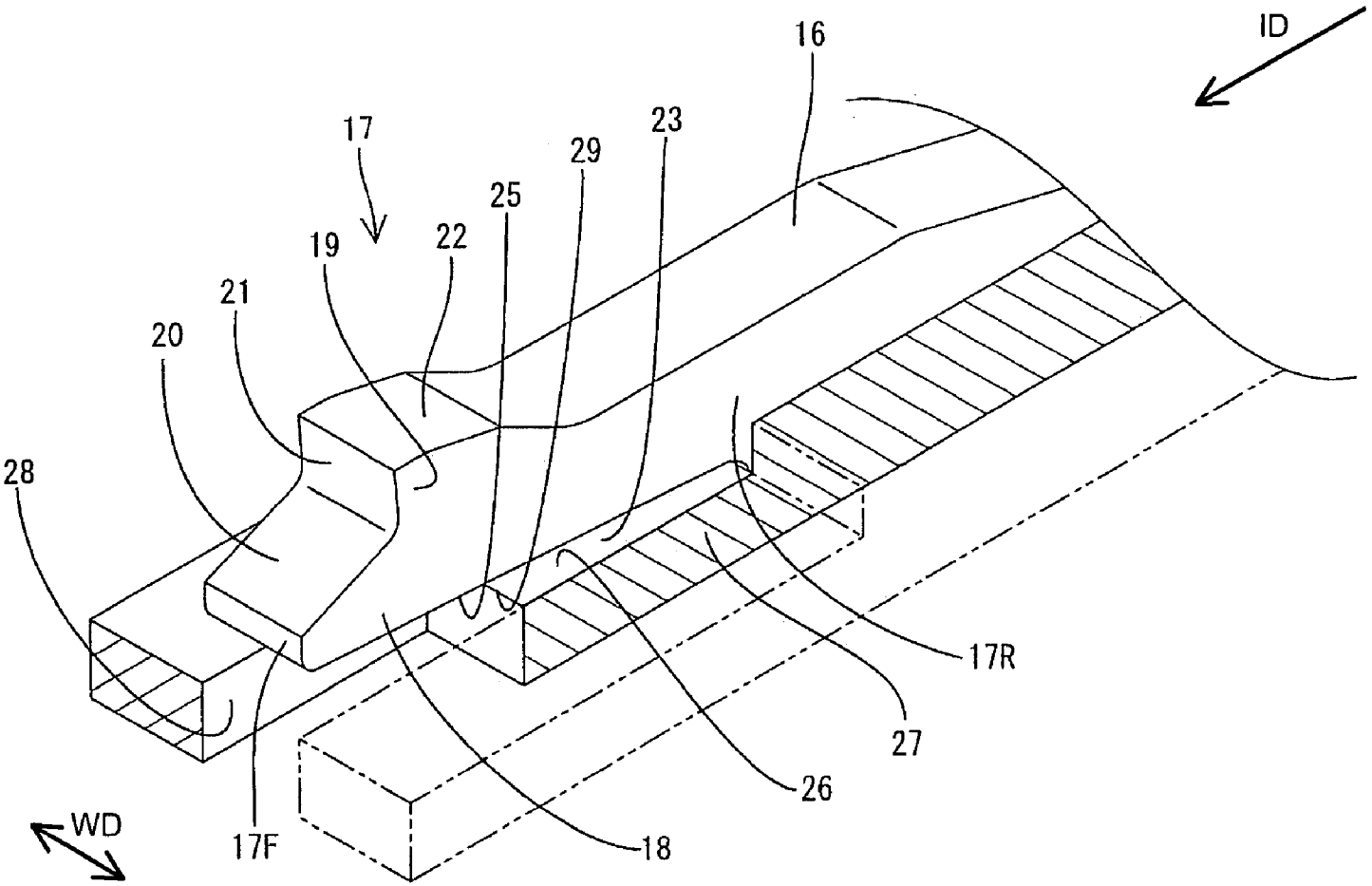
FIG. 1 is a perspective view of a first embodiment.
Figure 2:
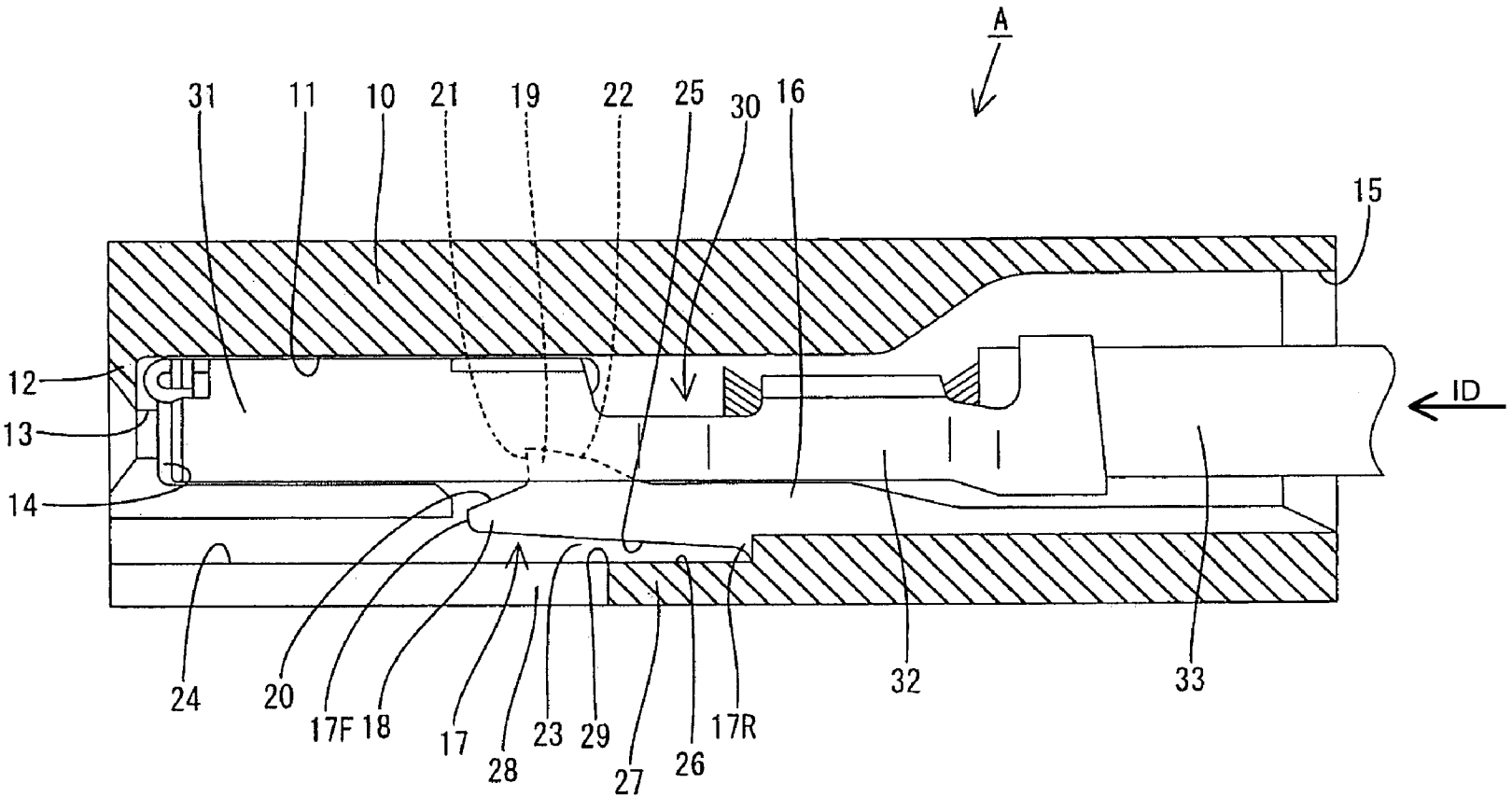
FIG. 2 is a section showing a state where a terminal fitting properly inserted is engaged with a locking portion.

A connector according to a first embodiment of the invention is identified by the letter A in FIGS. 1 to 4. The connector A has a housing 10 made e.g. of a synthetic resin. A cavity 11 penetrates the housing 10 in forward and backward directions and receives a terminal fitting 30. The housing 10 has a front wall 12, and a tab insertion opening 13 extends through the front wall 12 and into the cavity 11. A stopper 14 is formed on the front wall 12 adjacent the tab insertion opening 13 for stopping the terminal fitting 30 at a front end position in the cavity 11. A terminal insertion opening 15 is formed in the rear end of the cavity 11 and is dimensioned so that the terminal fitting 30 can be inserted into the cavity 11 from behind and along an insertion direction ID.

The cavity 11 has a bottom wall 16 and a lock 17 is formed unitarily with the bottom wall 16. The lock 17 has opposite front and rear ends 17F and 17R. A lock main body 18 is formed adjacent the rear end 17R of the lock 17 and is cantilevered to extend forward substantially along the bottom wall 16 of the cavity 11 at a position slightly behind the front end of the cavity 11. A locking projection 19 is formed near the front end 17F of the lock 17 and projects into the cavity 11 from the upper surface of the lock main body 18. The locking projection 18 engages the terminal 30 and prevents a backward displacement of the terminal 30 in a direction.

An area of the upper surface of the lock main body 18 behind the locking projection 19 is substantially flat and flush with the bottom wall 16 of the cavity 11 and is substantially parallel with the inserting direction ID of the terminal fitting 30 into the cavity 11. A jig engaging surface 19 is formed at the front end 17A of the lock main body 18 before the locking projection 19. The jig engaging surface 20 slopes down towards the front and is lower than the bottom wall 16 of the cavity 11. The width of the lock main body 18 is substantially constant from the base end 17R to the free end 17F and smaller than the widths of the terminal fitting 30 and the cavity 11.

The width of the locking projection 19 is equal to the width of the lock main body 18, and the opposite left and right surfaces of the locking projection 19 are substantially continuous and flush with the lateral surfaces of the lock main body 18. A locking surface 21 is formed at the front of the locking projection 19 and extends substantially normal to the inserting direction ID of the terminal fitting 30 into the cavity 11. A guiding surface 22 is formed on the top of the locking projection 19 and slopes down towards the back at an obtuse angle to the inserting direction ID.

The lock 17 is resiliently deformable substantially vertically along a deforming direction DD with the rear end 17R as a support. A deformation space 23 is formed in an internal area of the housing 10 below the lock 17 and at a side of the lock 17 opposite from the cavity 11 for permitting deformation of the lock 17 down in the deforming direction DD. A mold-removal space 24 is open in the front of the housing 10 before the deformation space 23 and communicates with the deformation space 23. A slanted surface 25 is formed on the lower surface of the lock main body 18, and hence defines the ceiling of the deformation space 23. The slanted surface 25 slopes up towards the front. A flat surface 26 is formed on the bottom of the deformation space 23 and is aligned substantially horizontally and parallel with the inserting direction ID of the terminal fitting 30 into the cavity 11. Thus, a vertical dimension of the deformation space 23 is smallest at the rear end 17R of the lock 17 and gradually increases to a maximum at the front end 17F of the lock 17.

A vertical dimension of the deformation space 23 at the front end 17F of the lock 17 is smaller than an upward projecting distance of the locking projection 19 from the lock main body 18, i.e. a vertical dimension of an area of engagement of the locking projection 19 with the terminal fitting 30. However, an outer wall 27 of the housing 10 below the deformation space 23 is formed with an accommodating space 28 that communicates with a front area of the deformation space 23. The accommodating space 28 extends to the lower surface of the outer wall 27 and thus exposes the deformation space 23 to the outside of the housing 10. The accommodating space 28 aligns with the lock 17 in the width direction WD and is wider than the lock main body 18. An excessive deformation preventing portion 29 is formed at a corner of the outer wall 27 of the housing 10 where the rear end surface of the accommodating space 28 meets the bottom surface of the deformation space 23. The excessive deformation preventing portion 29 prevents excessive deformation of the lock 17 in the deforming direction DD.

A rectangular tubular terminal main body 31 is formed at the front of the terminal fitting 30 and wire connecting barrels 32 are formed behind the terminal main body 31. The wire connecting portion 32 can be crimped, bent or folded into connection with an end of a wire 33. An unillustrated resilient contact piece is provided in the terminal main body 31, and a locking hole (not shown) is formed in the bottom plate of the terminal main body 31.

Figure 3:
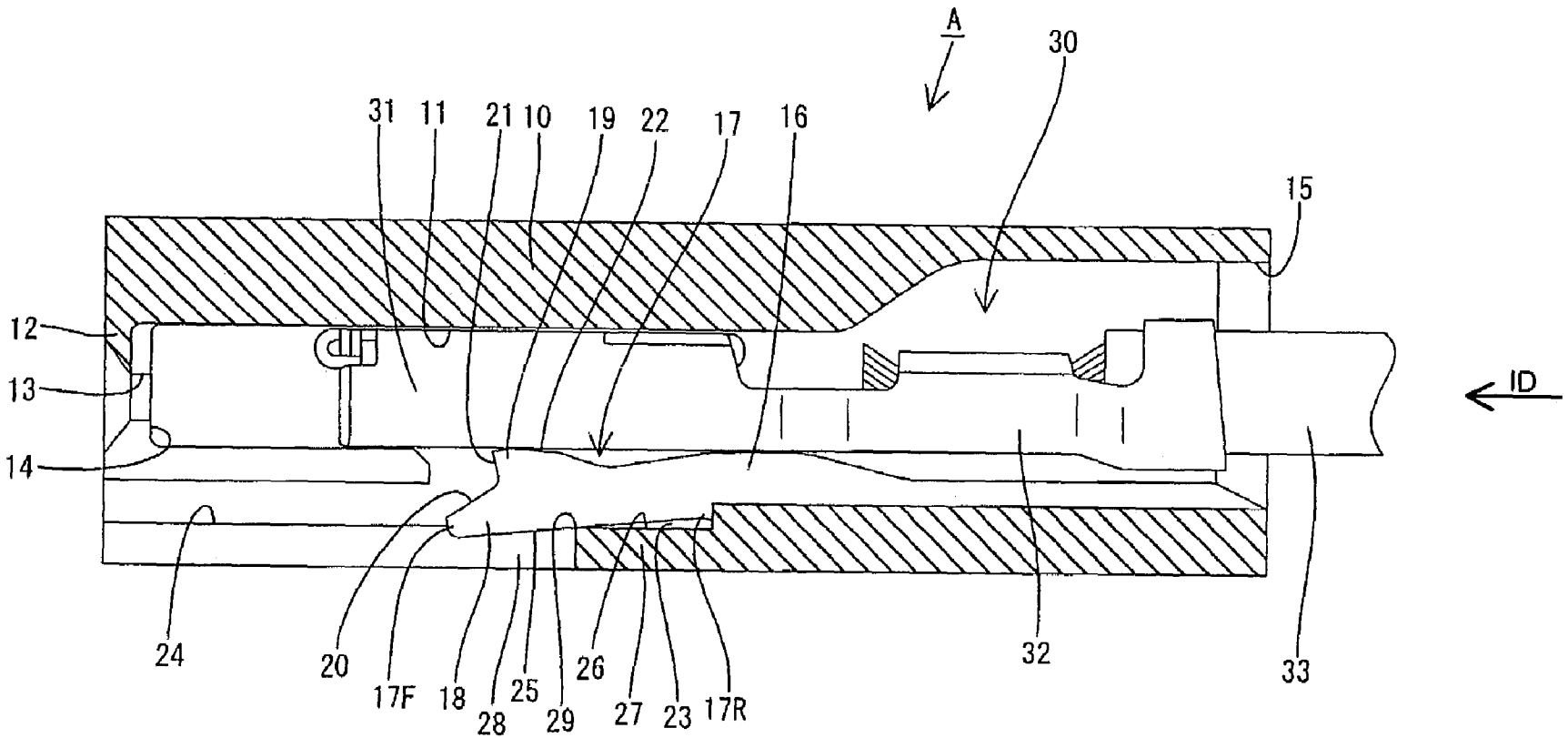
FIG. 3 is a section showing a state where the locking portion is resiliently deformed in the insertion process of the terminal fitting.
Figure 4:
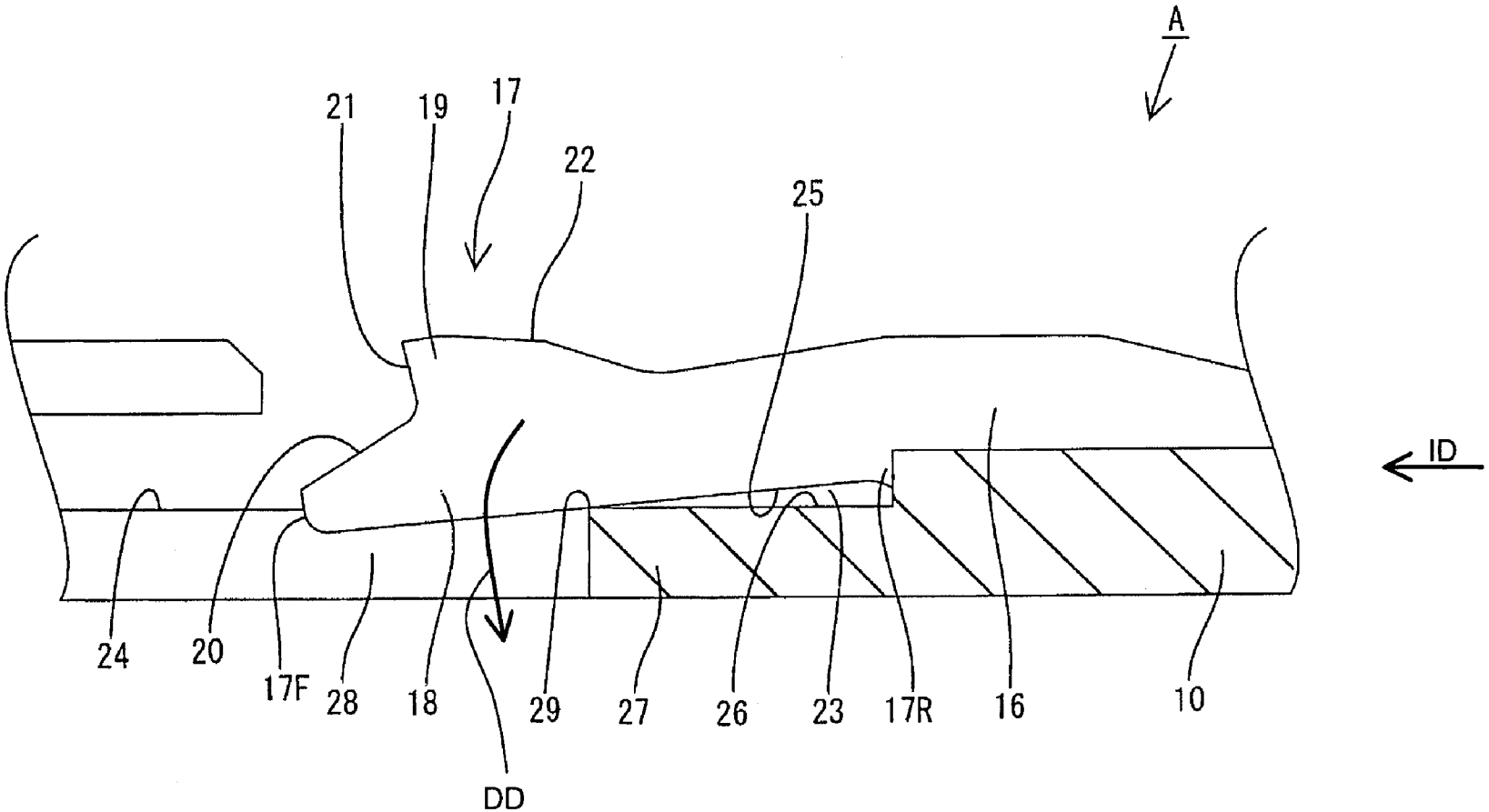
FIG. 4 is a partial enlarged view of FIG. 3.
Figure 5:
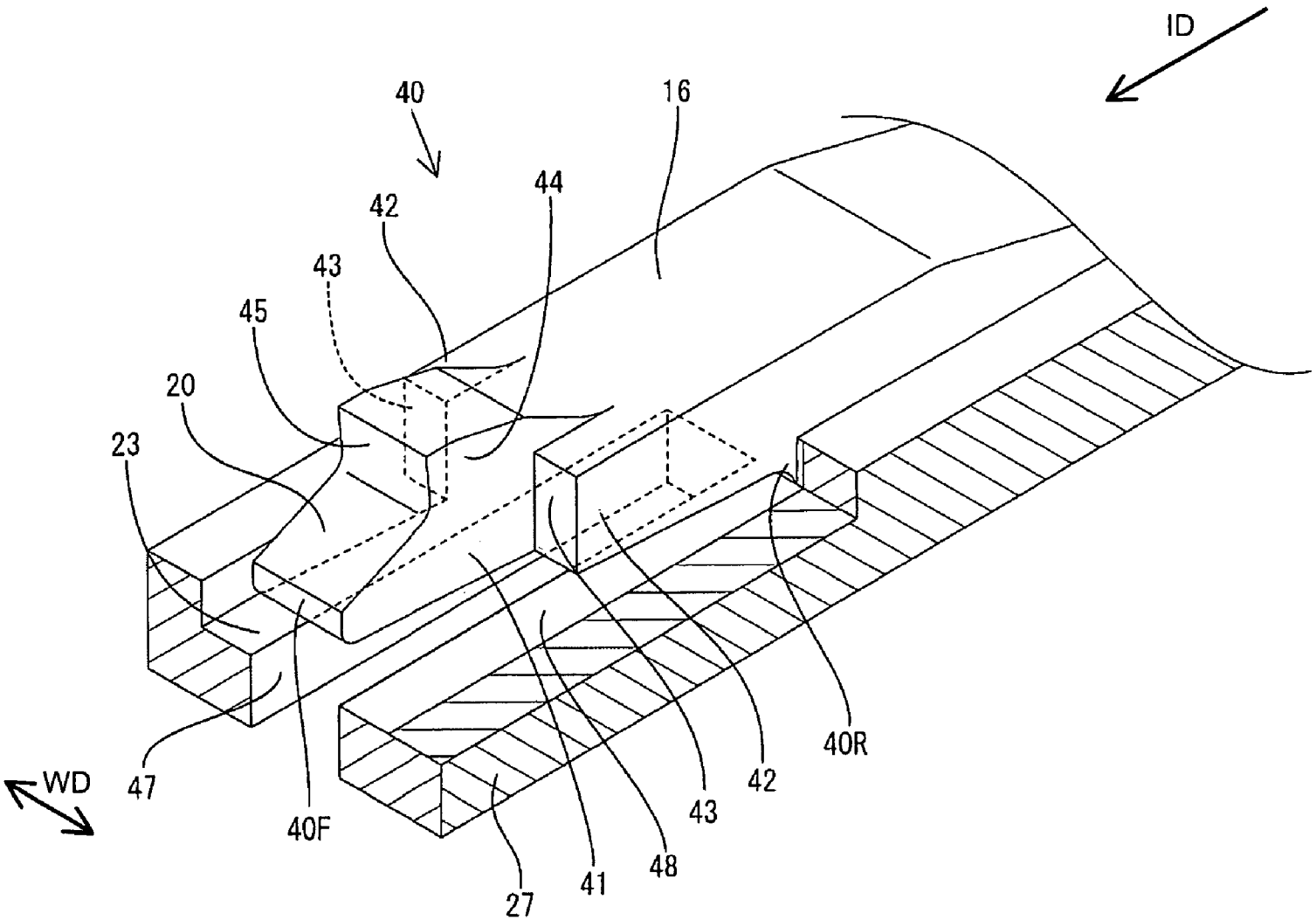
FIG. 5 is a perspective view of a second embodiment.
Figure 6:
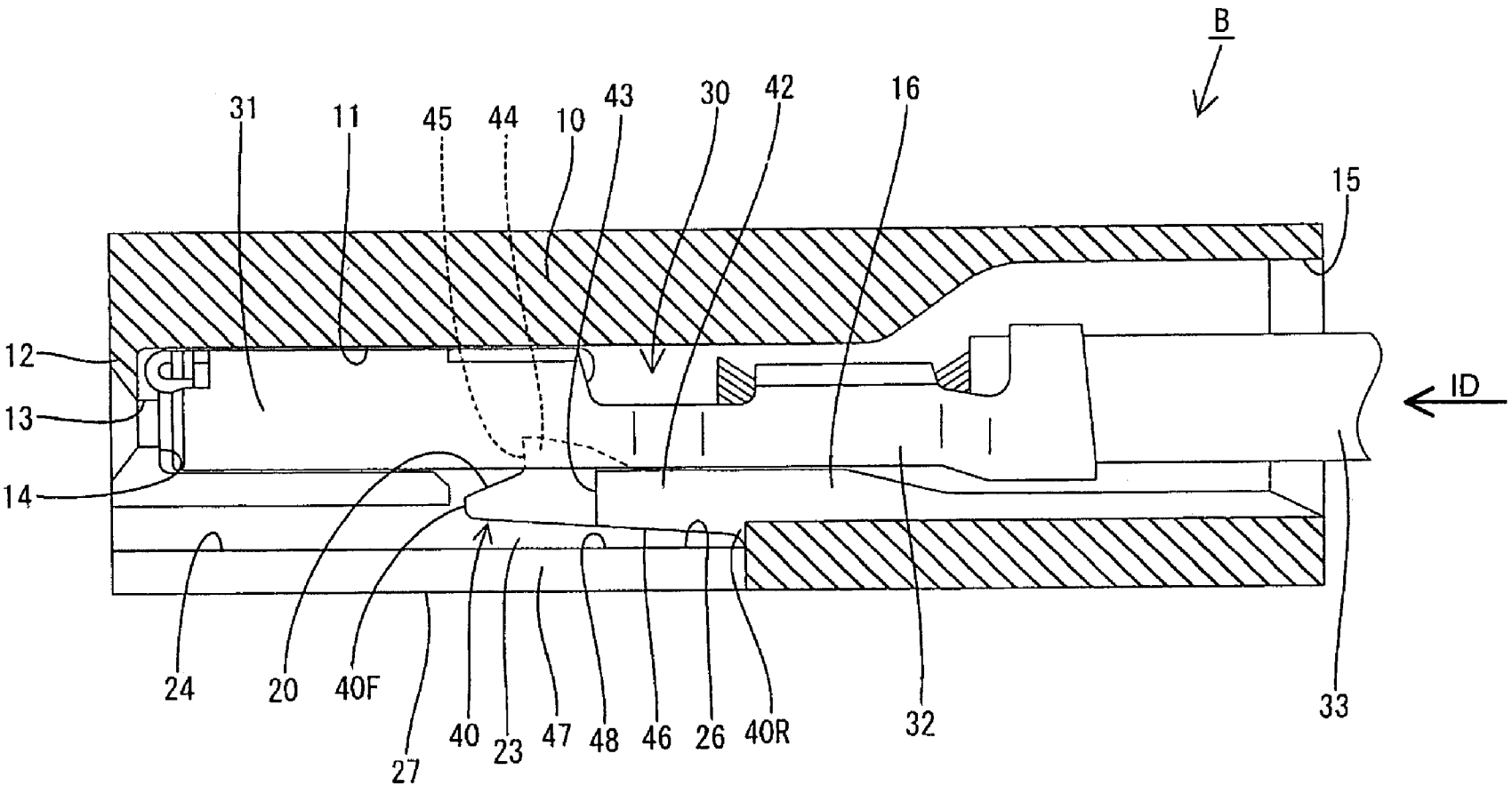
FIG. 6 is a section showing a state where a terminal fitting properly inserted is engaged with a locking portion.
Figure 7:
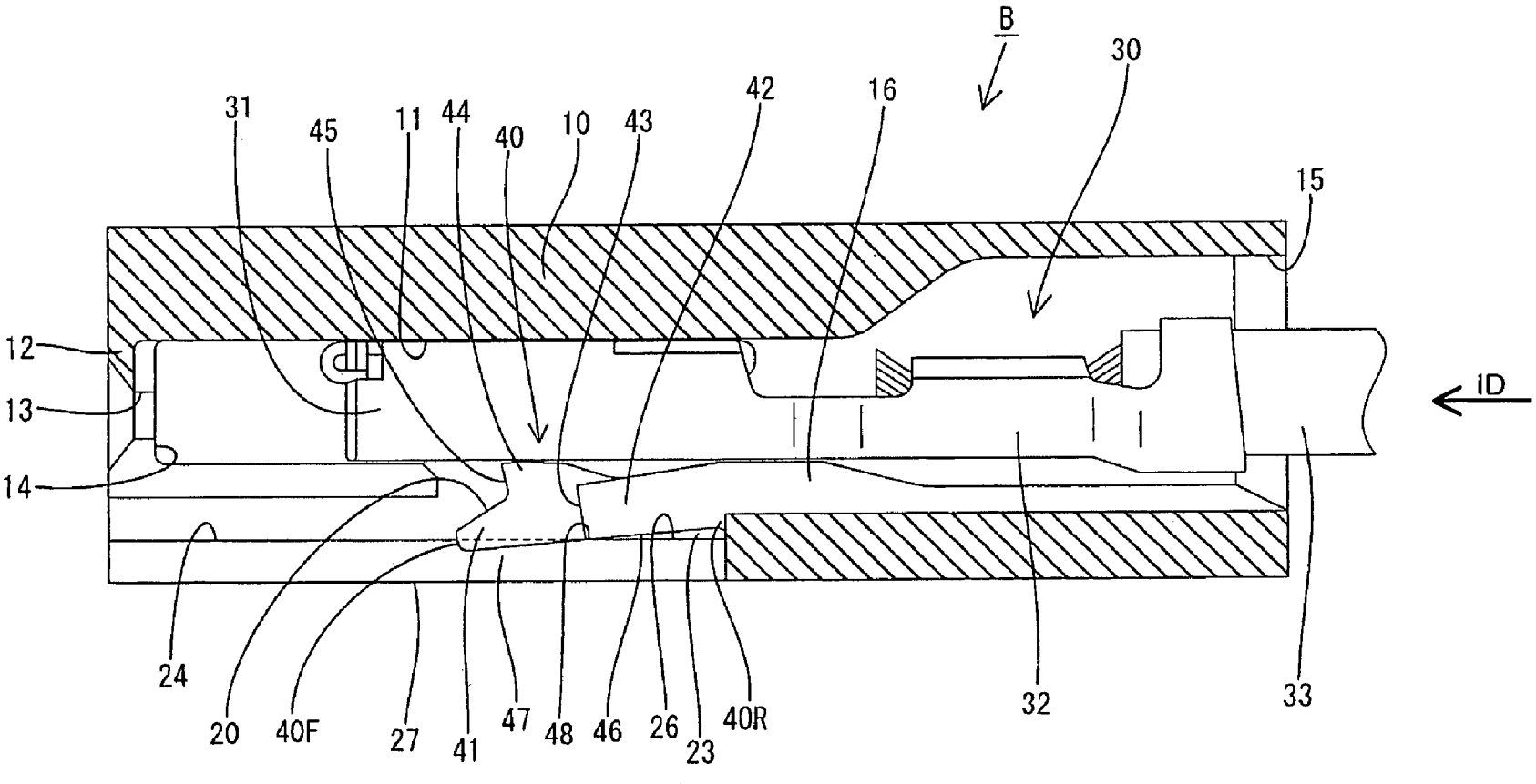
FIG. 7 is a section showing a state where the locking portion is resiliently deformed in the insertion process of the terminal fitting.
Figure 8:
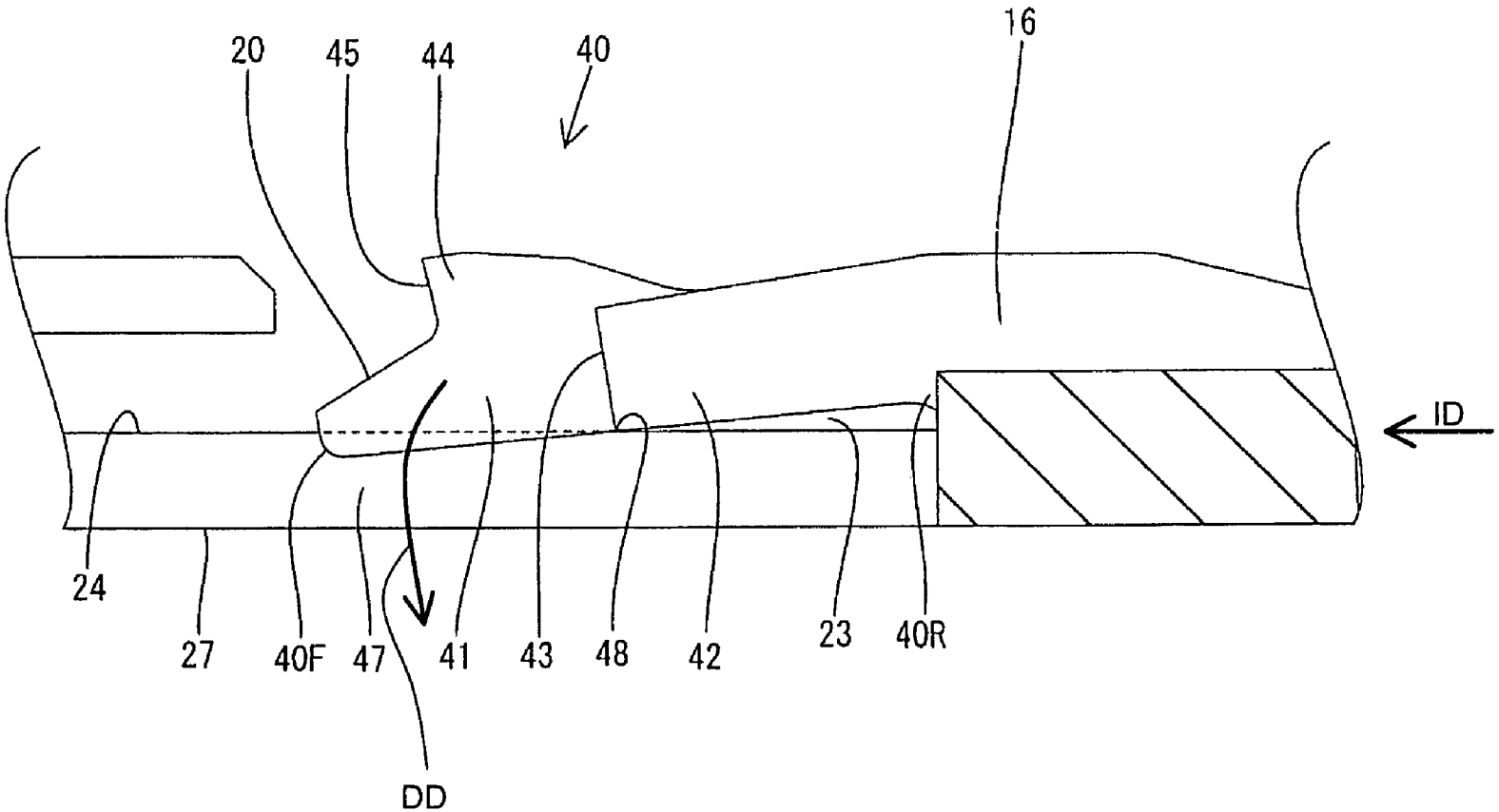
FIG. 8 is a partial enlarged view of FIG. 7.
Figure 9:
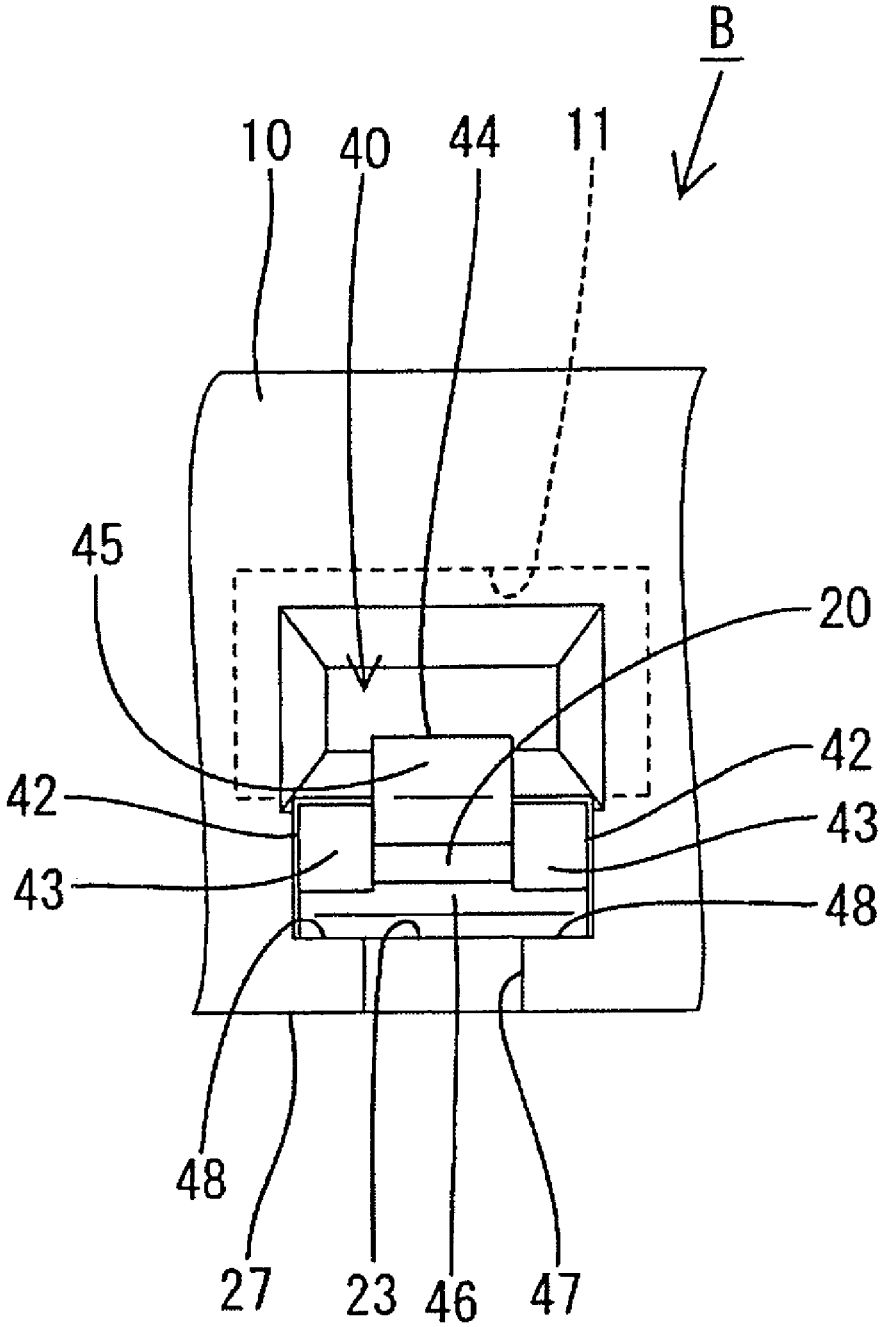
FIG. 9 is a front view showing an opening of a cavity and the shape of the locking portion.
Figure 10:
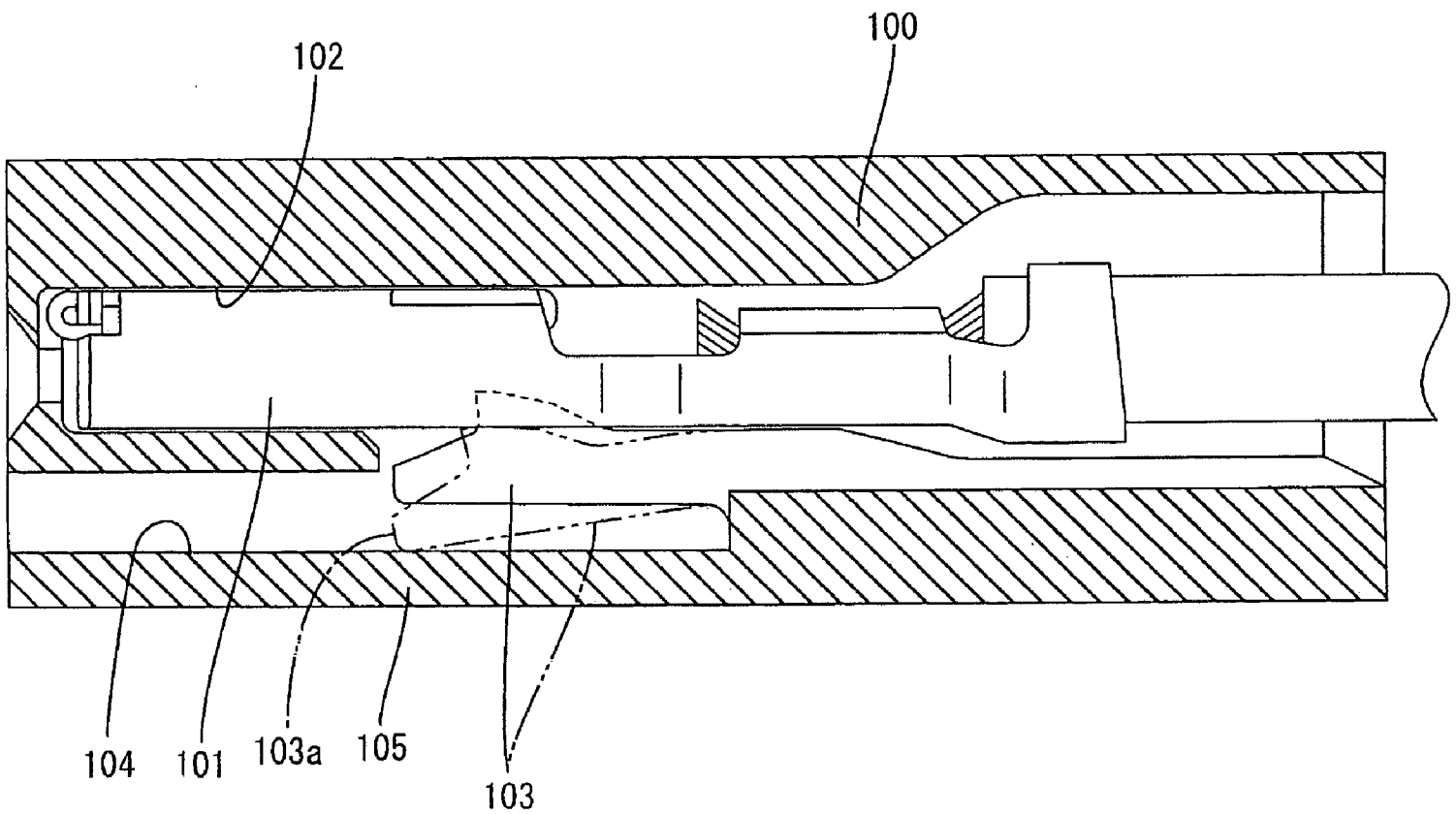
FIG. 10 PRIOR ART
FIG. 10 is a section of a prior art connector.

The terminal fitting 30 is inserted into the cavity 11 in the inserting direction ID. As a result, the bottom surface of the terminal main body 31 contacts the guiding surface 22 of the locking projection 19 of the lock 17. The bottom surface of the terminal main body 31 moves along the inclined guiding surface 22 as the insertion of the terminal fitting 30 progresses. As a result, the lock 17 is deformed down in the deforming direction DD with the rear end 17R as a support while bringing a front part of the lock main body 18 down in the deforming direction DD. As a result the lock 17 enters the deformation space 23, as shown in FIG. 3. A vertical displacement of the free front end 17F of the lock 17 in the deforming direction DD is larger than the maximum vertical dimension of the deformation space 23. However, an area of the deformation space 23 at a front side communicates with the accommodating space 28. Thus, the free front end 17F of the lock 17 and a bottom of the front part of the lock 17 can enter the accommodating space 28. The part of the lock 17 that undergoes a largest deformation can at least partly enter the accommodating space 28 in this way. Thus, the lock 17 can be deformed without a problem.

The front end of the terminal main body 31 contacts the stopper 14 when the terminal fitting 30 is inserted to a proper insertion position in the cavity 11 to prevent any further insertion of the terminal fitting 30. The lock 17 then is restored resiliently up in a direction substantially opposite to the deforming direction DD so that the locking projection 19 fits into the locking hole of the terminal fitting 30. This enables the locking surface 21 of the locking projection 19 to engage the front end edge of the locking hole, with the result that the terminal fitting 30 is held so as not to come out of the cavity 11.

The locked terminal fitting 30 can be withdrawn from the housing 10 by inserting a long narrow jig (not shown) into the mold-removal space 24 from the front of the housing 10. Thus, the leading end of the jig contacts the jig engaging surface 20 of the lock 17 from above to push the lock 17 down in the deforming direction DD. The locking projection 19 comes out of the locking hole and is displaced to a position below the terminal main body 31, thereby freeing the terminal fitting 30 from the locked state. The wire 33 is pulled back while maintaining this freed state so that the terminal fitting 30 is withdrawn from the cavity 11.

The excessive deformation preventing portion 29 is provided to ensure that the jig does not deform the lock 17 in the deforming direction DD beyond the resiliency limit of the lock 17. Specifically, the lock 17 can be deformed until the locking projection 19 disengages from the terminal fitting 30. However, the lower surface of the lock main body 18 at an intermediate position between the rear end 17R and the free front end 17F then contacts the excessive deformation preventing portion 29 to prevent any further downward deformation of the lock 17 in the deforming direction DD. At this time, the lower surface 25 of the lock 17 is in line contact with the excessive deformation preventing portion 29 along a horizontal line substantially normal to the deforming direction DD. Further, a part of the free front end 17F of the lock main body 18 is in the accommodating space 28, but does not project out of the housing 10.

As described above, a part of the lock 17 behind the free front end 17F contacts the excessive deformation preventing portion 29 to prevent excessive deformation of the lock 17 when the lock 17 is deformed resiliently into the deformation space 23. Thus, as compared to a connector in which the free end of a lock contacts an excessive deformation preventing portion, the excessive deformation preventing portion 29 is closer to the lock 17 along vertical deforming direction DD of the lock 17. In other words, the position of the excessive deformation preventing portion 29 is higher. Thus, the connector A can be miniaturized along the deforming direction DD of the lock 17.

Further, the housing 10 is formed with the accommodating space 28 for accommodating the part of the lock 17 at the side of the free end 17F while the lock 17 is held in contact with the excessive deformation preventing portion 29. This part of the lock 17 does not project out of the housing 10. Furthermore, the accommodating space 28 is exposed at the outer surface of the housing 10. Thus, the connector A is smaller by as much as the thickness of the outer wall as compared to a connector in which an accommodating space is closed by an outer wall extending along the outer surface of a housing.

A connector according to a second embodiment of the invention is identified by the letter B in FIGS. 5 to 9. The connector B differs from the first embodiment in the constructions of a lock 40, an accommodating space 47 and excessive deformation preventing portions 48. Other elements are the same as or similar to the first embodiment. These similar elements are identified by the same reference numerals, but are not described again.

The lock 40 of the second embodiment has two transversely symmetrical contact portions 42 formed unitarily on the opposite lateral (left and right) surfaces of a locking main body 41. The contact portions 42 extend continuously along forward and backward directions from an intermediate position behind a free front end 40F of the lock main body 41 to a rear end 40R. The upper surfaces of the contact portions 42 are substantially continuous and flush with the upper surfaces of the lock main body 41, whereas the lower surfaces thereof are substantially continuous and flush with a slanted lower surface 46 of the lock main body 41. Front end surfaces 43 of the contact portions 42 are substantially normal to the upper surfaces of the contact portions 42 and substantially normal to an inserting direction ID of the terminal fitting 30 into the cavity 11. The front end surfaces 43 of the contact portions 42 are before the rear end of a locking projection 44, but behind the front locking surface 45 of the locking projection 44.

The accommodating space 47 is formed in a front area extending from the front end of the deformation space 23 to the rear end thereof, i.e. from the free front end 40F of the lock 40 to the rear end 40R. The accommodating space 47 is wider than an area of the lock 40 where the contact portions 42 are not formed, but narrower than an area of the lock 40 where the lateral contact portions 42 are formed. Two excessive deformation preventing portions 48 are formed on the upper surface of the outer wall 27 to face the contact portions 42. The excessive deformation preventing portions extend substantially horizontally and parallel with the inserting direction ID of the terminal fitting 30 into the cavity 11. The upper surface of the outer wall 27 formed with the excessive deformation preventing portions 48 is at substantially the same height as the lower surface 26 of the deformation space 23 of the first embodiment (i.e. boundary surface between the deformation space 23 and the accommodating space 47).

The locking portion 40 can be deformed resiliently down in the deforming direction DD by a jig (not shown). Thus, the bottom edges of the front ends of the contact portions 42 contact the excessive deformation preventing portions 48 to prevent any further deformation of the lock 40 in the deforming direction DD and into the deformation space 23 or the accommodating space 48. As a result, excessive deformation of the lock 40 beyond its resiliency limit is prevented. At this time, the contact portions 42 and the excessive deformation preventing portions 48 come into line contact along a horizontal line substantially normal to the deforming direction DD of the lock 40. A part of the lock 40 at and near the free front end 40F is in the accommodating space 47.

In the second embodiment, the locking 40 is formed with a pair of contact portions 42 partly projecting sideways from the left and right surfaces of the locking 40 behind the free front end 40F. These contact portions 42 simultaneously contact the excessive deformation preventing portions 48. Accordingly, the posture of the lock 40 is difficult to incline transversely, which prevents the lock 40 from being twisted.

The lock 40 is resiliently deformed with the rear end 40R as a support. The contact portions 42 extend continuously from the rear end 40R of the lock 40 toward the front end 40F. Thus, the width of the lock 40 at the rear end 40R is larger, and the lock 40 is more rigid, thereby improving the reliability of the function of the lock 40.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The terminal fitting is a female terminal fitting having the substantially rectangular tube at the front side in the foregoing embodiments. However, the invention is also applicable to male terminal fittings having tabs at front sides.

The accommodating space is exposed at the outer surface of the housing in the foregoing embodiments. However, it may not be exposed or only be partly exposed at the outer surface of the housing.

The free of the lock is accommodated in the accommodating space with the lock held in contact with the excessive deformation preventing portions in the foregoing embodiments. However, the free end of the lock may project out from the outer surface of the housing when the lock contacts the excessive deformation preventing portions according to the present invention.

Although the excessive deformation preventing portions are formed unitarily in the housing in the foregoing embodiments, they may be formed separately from the housing and assembled into the housing.

In the foregoing embodiments, the lock contacts the excessive deformation preventing portions substantially at the same time the lock is deformed until the locking projection is disengaged from the terminal fitting. However, the lock may contact the excessive deformation preventing portions upon being deformed to an extent larger than necessary to disengage the locking from the terminal fitting.

Left and right contact portions 48 are formed in the second embodiment. However, one contact portion may be formed at only one of the left and right sides according to the invention.

The contact portions extend substantially continuously from the base end of the lock towards the free end in the second embodiment. However, the contact portions may be distanced from the base end towards the free end.

Although the upper surfaces of the contact portions are at the substantially same height as the upper surface of the lock main body in the second embodiment, they may be lower than the upper surface of the lock main body according to the present invention.

What is claimed is:

1. A connector having a housing having opposite front and rear ends, the housing comprising:

at least one cavity formed in the housing and extending substantially from the front end to the rear end;

a lock cantilevered forward along an inner wall of the cavity and having a free front end, the lock being deformable in a deformation direction towards a deformation space at a side of the lock opposite from the cavity due to interference with a terminal fitting in the process of inserting the terminal fitting into the cavity, and the lock being resiliently restorable to engage the terminal fitting for retaining the terminal fitting in the cavity when the terminal fitting reaches a proper insertion position; and at least one excessive deformation preventing portion defining a part of the deformation space opposed to the lock in the deformation direction and spaced from the lock when the lock is not deformed, the deformation preventing portion being rearward of the free front end of the lock so that portions of the housing outward of the deformation space in the deformation direction of the lock define an accommodation space that is open to areas outside the housing, portions of the lock adjacent the free front end passing into the accommodation space as the lock is deformed, and portions of the lock rearward of the free front end contacting the excessive deformation preventing portion while the free front end of the lock is exposed exteriorly in the accommodation space for preventing deformation of the lock beyond a resiliency limit.

2. The connector of claim 1, wherein the lock is formed with at least one contact portion projecting sideways from a lateral surface of the lock behind the free front end of the lock for contacting the excessive deformation preventing portion.

3. The connector of claim 2, wherein the at least one contact portion comprises two contact portions projecting from opposite side surfaces of the lock for simultaneously contacting the excessive deformation preventing portion.

4. The connector of claim 3, wherein the contact portions extend from a rear end of the lock towards the free front end.

5. The connector of claim 1, wherein the accommodating space is wider than portions of the lock where the contact portions are not formed, but narrower than an area of the lock where the contact portions are formed.

6. The connector of claim 1, wherein a part of the lock and the excessive deformation preventing portions come substantially into line contact along a line substantially normal to a deforming direction of the lock.

7. The connector of claim 1, wherein a vertical dimension of the deformation space is smallest at a rear end of the lock and gradually increases towards the front end of the lock.

8. The connector of claim 1, wherein a displacement in the deforming direction of the front end of the lock is larger than a maximum dimension of the deformation space in the deformation direction.

* * * * *